US008646629B2

(12) United States Patent
Paschke

(10) Patent No.: US 8,646,629 B2
(45) Date of Patent: Feb. 11, 2014

(54) CRANE JIB CONSTRUCTION COMPRISING BIASED TENSILE ELEMENTS

(75) Inventor: Franz Paschke, Sande (DE)

(73) Assignee: Manitowoc Crane Group France SAS, Ecully (FR)

( * ) Notice: Subject to any disclaimer, the term of this patent is extended or adjusted under 35 U.S.C. 154(b) by 246 days.

(21) Appl. No.: 13/090,974

(22) Filed: Apr. 20, 2011

(65) Prior Publication Data

US 2011/0272378 A1 Nov. 10, 2011

(30) Foreign Application Priority Data

May 10, 2010 (DE) ..... 20 2010 006 624

(51) Int. Cl.
*B66C 13/16* (2006.01)

(52) U.S. Cl.
USPC ..... 212/278; 212/276; 212/347

(58) Field of Classification Search
USPC ..... 212/276, 278, 347, 271; 52/650.1, 52/651.05
See application file for complete search history.

(56) References Cited

U.S. PATENT DOCUMENTS

| | | | | |
|---|---|---|---|---|
| 5,545,987 | A | 8/1996 | Schutt et al. | |
| 6,586,084 | B1 * | 7/2003 | Paschke et al. | 428/298.1 |
| 6,755,212 | B1 | 6/2004 | Anderson et al. | |
| 7,293,669 | B2 | 11/2007 | Paschke | |
| 2004/0245201 | A1 | 12/2004 | Paschke | |
| 2011/0068076 | A1 | 3/2011 | Schmidt et al. | |

FOREIGN PATENT DOCUMENTS

| | | | |
|---|---|---|---|
| DE | 41 34 787 | | 4/1993 |
| DE | 42 43 878 | | 7/1994 |
| DE | 103 15 989 | | 11/2004 |
| DE | 102008013203 | A1 | 9/2009 |
| EP | 0 538 779 | | 10/1992 |
| EP | 0 525 736 | B1 | 10/1997 |
| EP | 968955 | A2 | 1/2000 |
| EP | 1466855 | A2 | 10/2004 |
| JP | H08-091788 | A | 4/1996 |
| JP | 05 037570 | A | 2/2005 |
| JP | 07 029351 | B | 2/2007 |
| WO | WO 2009112004 | A1 * | 9/2009 |

* cited by examiner

*Primary Examiner* — William A Rivera
*Assistant Examiner* — Angela Caligiuri
(74) *Attorney, Agent, or Firm* — Steven P. Shurtz; Brinks Gilson & Lione

(57) ABSTRACT

A jib part (10) for a crane, in particular a mobile crane, a includes an inner shaping shell (15), tensile elements (11) within hollow profiles (12) and a sheathing, made from a layer of transverse fibers (13) covered by a protective or slide layer (14). The tensile elements (11) are biased and fitted with sensors and/or actuators.

16 Claims, 4 Drawing Sheets

CRANE JIB CONSTRUCTION COMPRISING BIASED TENSILE ELEMENTS

BACKGROUND OF THE INVENTION

The invention relates to a jib, especially a crane jib, in particular a mobile crane jib, comprising a shaping shell, tensile elements and a sheathing.

Jibs according to the prior art are designed purely statically. Known configurations are:

- parts of isotropic materials, e.g. steel, aluminum, e.g. EP 0449208 A2; EP0668238 A1; DE 20004016 U1; EP 0814050 B1; DE 20 2009 009 143 U1;
- two- or multi-shell sandwich constructions, e.g. DE 199 48 830 B4; EP 0 117 774;
- combinations of steel, fiber composite with and without strain gauges, e.g. EP 0 968 955 B1; UK 1326943; DE44 08 444 C1; DE 10 2008 013 203 A1;
- fiber composite construction, e.g. U.S. Pat. No. 5,238,716; U.S. Pat. No. 5,333,422;
- guyed systems, e.g. DE 100 22 658; DE 200 20 974; DE 103 15 989.4-22.

All these constructions are passive. The effects occurring in crane operation cause local peak stresses in the edge regions, which have to be dimensioned correspondingly.

BRIEF SUMMARY OF THE INVENTION

The object of the invention is to optimize the construction with respect to the stresses. It is solved by a jib part for a crane comprising a shaping shell, tensile elements and a sheathing, characterized in that the tensile elements are biased and fitted with sensors.

In embodiments of the invention, the following configurations, now cited up to the description of figures, can be made:

The individual jib parts can be biased in defined manner with tensile elements, which control and monitor the utilization factor of the jib part by means of sensors and which are oriented in longitudinal direction or diagonally to the jib axis. The sensors can be coupled to actuators in a control loop such that the adaptive system counteracts the external effects. These tensile elements are located on the inner and/or outer face of a shaping shell or in the hollow profiles of a framework construction. For further stiffening and absorbing transverse forces, an external fiber composite layer extending transversely to the jib axis is applied partially or across the entire jib part or circumferentially wrapped. Inside and/or outside, the telescopic part is provided with an abrasion-resistant coating with good sliding properties.

Thus, one or more biased tensile elements may be incorporated in a hybrid construction and examined by means of sensors. The material can be better utilized. The signals can be included in the load torque limitation for control of the bending moments. The measured values are an essential component of the control process and of the security system.

If the system is actively biased, the compressive stress in the shaping shell can be kept nearly constant, since the tensile stress in the adjoining biasing elements decreases. Correspondingly, biasing forces remain nearly constant in the tensile region with simultaneous decrease of the compressive stress in the shell. The simultaneous monitoring with sensors greatly increases the security and the usability. Lightweight constructions are of existential importance in the crane construction and especially in the jib construction. Filigree constructions and the employment of lightweight, high-strength materials with utilization of the beneficially acting bias render the jib parts powerful and lightweight with slight deformations. Compared to guyed constructions, a pole according to the invention requires a smaller installation space. The payloads in the strength region and in the stability region can be continuously increased.

If the sensors are connected to actuators in a control loop, differential forces can be applied with the aid of a regulated or controlled adaption. By the applied longitudinal variations, constraining forces are introduced into the jib part, which counteract the physical effects. The thus statically indefinite system is capable of relocating a stress concentration. The different loads are approximately uniformly distributed to the cross-section, local peak stresses are avoided.

Up to now, the force component from the guy ropes in the jib longitudinal axis is returned through several jib parts. The individual connection elements are additionally loaded and have to be dimensioned greater (bolting units, cylinders, ropes etc.). By the bias of the individual jib parts according to the invention, the beneficially acting bias force is shorted, the connection elements are not additionally loaded and can be designed more economically.

Among other things, fiber-optic sensors or piezoelectric sensors can be employed as signal generators. Piezoelectric composites would be capable of recognizing damages to the component.

Actuators generate the variable tensile forces in the elements. Among other things, hydraulic cylinders, pneumatic cylinders, spindles, springs or piezoceramic actuators are employable.

With an intelligent electronic control loop, the individual jib parts are separately adapted to varied stresses in that a force acts on the respective biasing elements or they are induced to a length variation. The system of shell, tensile elements with sensors and/or actuators and envelope layer recognizes and regulates the utilization factor and distributes the loading harmonically across the cross-section. The payload and the usability are increased. The own weight is reduced and thus the stability values are increased. Deformation and vibrations greatly decrease, the fatigue strength increases and reciprocation of the load is decreased or prevented.

The cross-section of the shaping shell may be configured such that it is suitable for absorbing compressive stresses with low material strength. A shaping with outwardly curved shells without sharp-edged transitions is to be preferred.

Preferred materials for manufacturing the shaping shell are fine-grain steel, aluminum or fiber composites among other things.

As the tensile elements, preferably, rods, wires or discs can be employed. The division across the cross-section is arbitrary. The tensile elements are distributed all-over or partially across the cross-section. Preferably, they are disposed between the slide bearings in order to also employ anisotropic materials having low strengths transversely to the fiber longitudinal direction. The orientation of the tensile elements can extend in jib direction or obliquely thereto. A combination of obliquely and longitudinally extending tensile elements counteracts the bending and torsion load of the jib. If anisotropic materials are disposed on the slide bearing surfaces, it has to be taken care that the slide and sheathing layers correspondingly distribute the high concentrated transverse forces from the bearings. Suitable materials are carbon fibers, natural fibers, high-strength steel wires or highly modular plastic fibers, among other things.

According to material or case of application, the cross-sectional shape of the tensile elements is arbitrary. The anchorage and the force application of the tensile elements are located in or at the end frames of the jib part. The tensile elements are distributed in hollow profiles, channels or in an elastic matrix across the shaping shell. If the tensile elements constitute a shear-resistant unit with the shaping shell and/or the sheathing, they have to be biased before connection. If the tensile elements are between the shaping shell and the transverse winding without connection means, they are clamped by the bending deformation and constitute a form-fit connection with the shell and the transverse winding.

If the tensile elements are located in hollow profiles, thus, they are preferably connected to the shaping shell in shear-resistant manner and are supporting elements of the cross-section. By the combination of the shell, the hollow profiles and the sheathing, the advantageous stability promoting sandwich construction results.

If the belts of a grid or framework construction are constituted of hollow profiles, the tensile units according to the invention can positively influence supporting behavior, fatigue strength and usability, here too.

The tensile elements are advantageously protected from damages and environmental influences.

The circumferential winding maintains the tensile elements extending in longitudinal axis in their position and prevents detachment from the shaping shell. Materials are preferred, which can absorb high compressive forces transversely to their longitudinal axis (glass fiber, natural fiber, highly modular plastic fibers, etc.). The circumferential material layer absorbs transverse forces, and the buckling strength is increased by the stiffening effect, and the risk of breakdown in shell constructions is reduced. The circumferential fiber composite layer protects the tensile elements in association with the abrasion resistant and slidable cover layer.

In the attached drawings, embodiments of the present invention are explained in more detail, wherein:

DETAILED DESCRIPTION OF THE INVENTION

Figure 1:
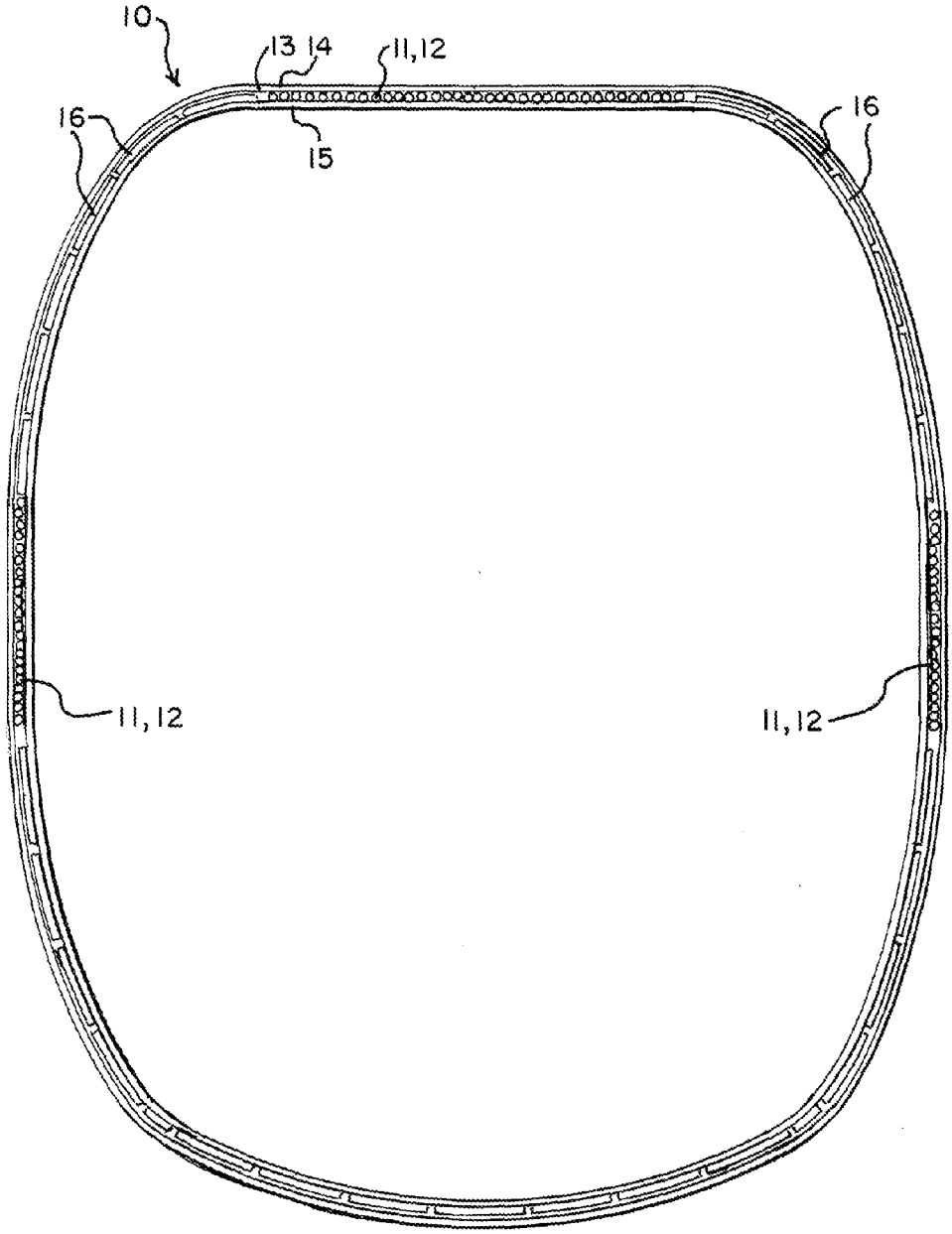
FIG. 1 shows a cross-section through a jib configured according to the invention.
Figure 2:
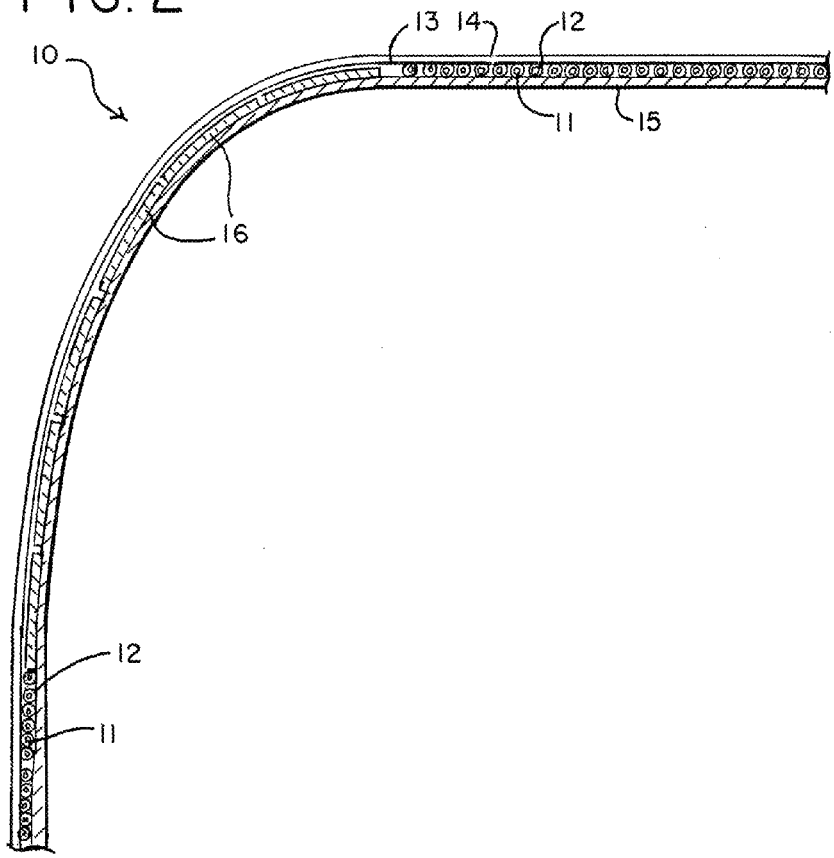
FIG. 2 shows an enlarged detail of the cross-section of FIG. 1.
Figure 3:
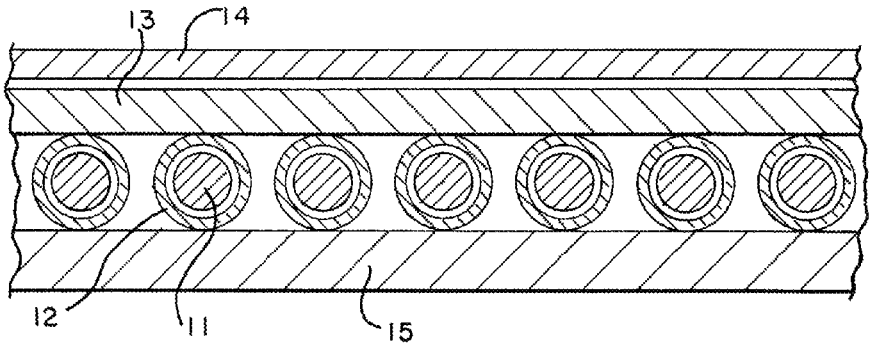
FIG. 3 shows an once more enlarged detail of the top shell piece of FIG. 2.
Figure 4:
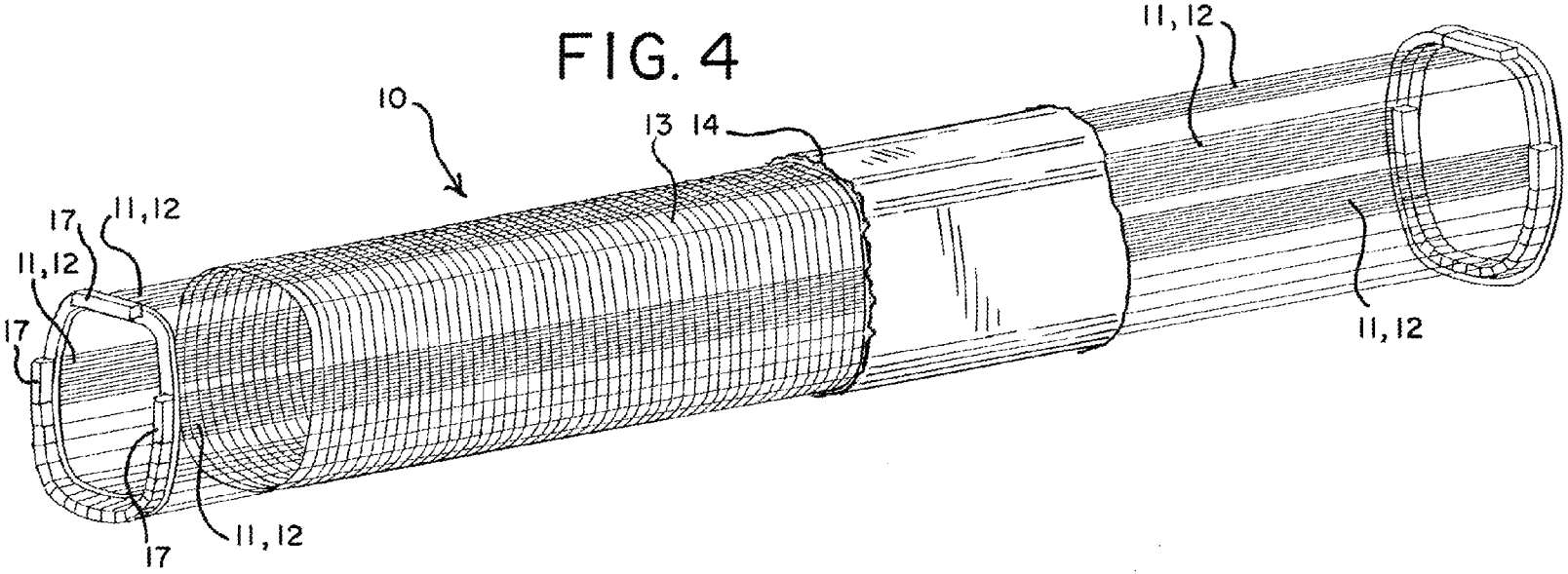
FIG. 4 shows an oblique grid view of a crane jib configured according to the invention.
Figure 5:
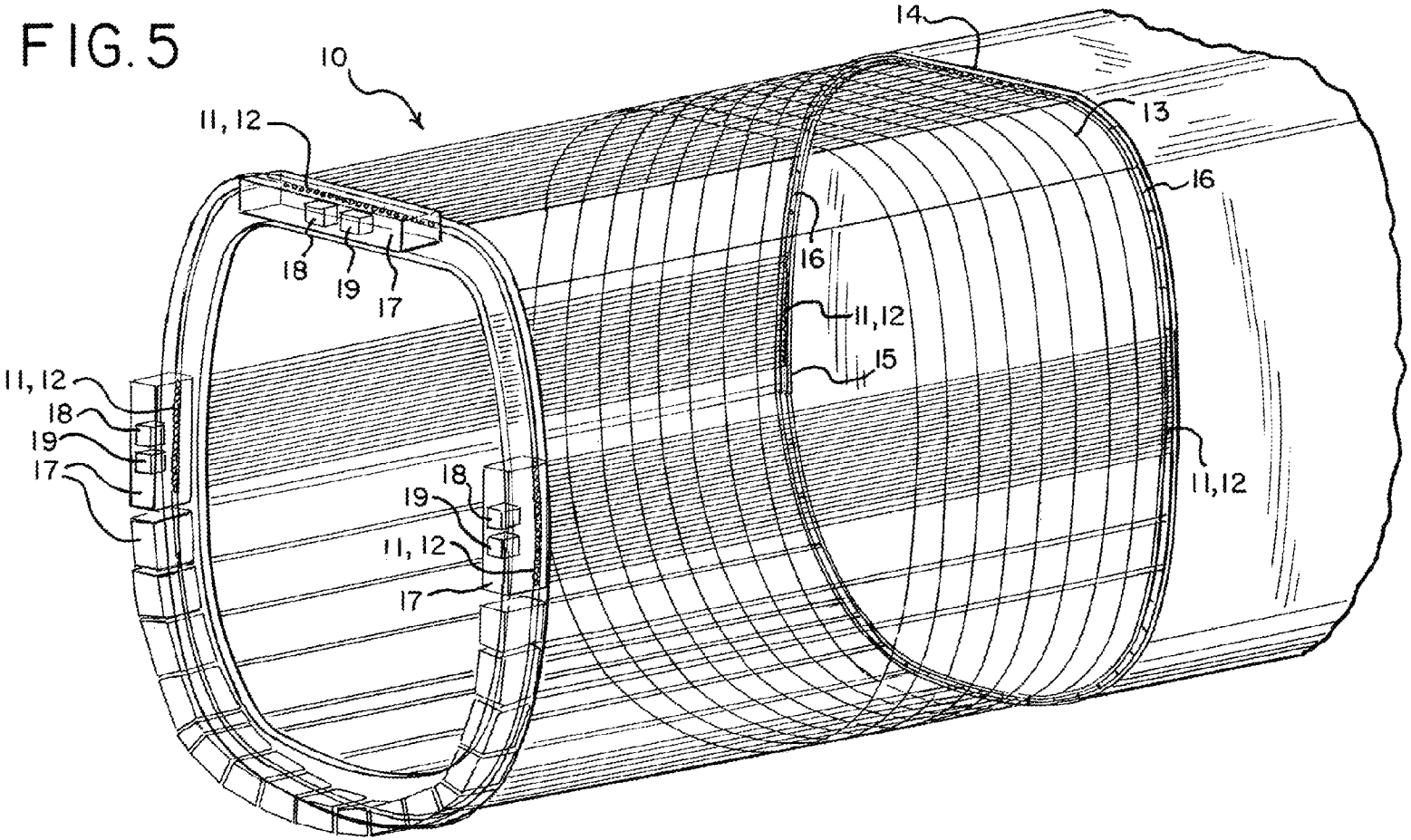
FIG. 5 shows an enlarged view of the front collar region of the jib represented in FIG. 4.

The jib variants illustrated in the drawings can be configured as it is represented above in general and herein for various embodiments. In the drawings, the reference character 10 very generally refers to the jib or the jib cross-section. Biased tensile elements are designated by the reference character 11, which are within hollow profiles 12. The reference character 13 refers to a layer of transverse fibers, while a protective or slide layer is designated by 14. The inner shell 15 is a shaping shell, and the discs or disc elements disposed in the transition region between top shell and vertical section have been provided with the reference character 16. The arrangement of the anchors, in which the sensors 18 and/or actuators 19 are accommodated, are indicated with the reference character 17.

The invention claimed is:

1. A jib part for a crane comprising a shaping shell, biased tensile elements and a sheathing, characterized in that the tensile elements are fitted with sensors configured to sense a tensile stress in the tensile elements, the sensors being connected via a control loop to actuators, and wherein the actuators are connected to the tensile elements and actively apply a variable force to the tensile elements, which counteracts the sensed tensile stress so as to introduce a variable pressure bias into the jib part.

2. The jib part according to claim 1 characterized in that the jib part adaptively counteracts external effects using the sensors and actuators through the control loop.

3. The jib part according to claim 1 characterized in that anchors of the tensile elements are disposed in or at end frames of the jib part.

4. The jib part according to claim 1 characterized in that the sensors are integrated in the tensile elements.

5. The jib part according to claim 1 characterized in that the tensile elements have ends and the actuators are located at the ends of the tensile elements.

6. The jib part according to claim 1 characterized in that the tensile elements are encased by a fiber layer extending transversely to a longitudinal axis of the jib part.

7. The jib part according to claim 1 characterized in that the tensile elements extend in channels or hollow profiles.

8. The jib part according to claim 7 characterized in that the shaping shell, the channels or hollow profiles with the tensile elements and the sheathing are connected in a shear-resistant manner and constitute a sandwich profile.

9. The jib part according to claim 1 characterized in that the tensile elements are embedded in an elastic matrix.

10. The jib part according to claim 1 characterized in that the tensile elements are wrapped and clamped.

11. The jib part according to claim 1 characterized in that the tensile elements are connected to the shaping shell in a shear-resistant manner.

12. The jib part according to claim 1 characterized in that the tensile elements extend in a direction parallel to a longitudinal axis of the jib part.

13. The jib part according to claim 1 characterized in that the tensile elements have ends and the actuators are located at the ends of the tensile elements.

14. The jib part according to claim 1 characterized in that the tensile elements are connected to the sheathing in a shear-resistant manner.

15. The jib part according to claim 1 characterized in that the tensile elements are connected to the shaping shell and to the sheathing in a shear-resistant manner.

16. The jib part according to claim 1 characterized in that the tensile elements extend in direction obliquely to a longitudinal axis of the jib part.

* * * * *